US008453574B2

(12) United States Patent
Rönn

(10) Patent No.: US 8,453,574 B2
(45) Date of Patent: Jun. 4, 2013

(54) MCD SHELL

(75) Inventor: Torsten Rönn, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 781 days.

(21) Appl. No.: 12/094,738

(22) PCT Filed: Oct. 10, 2006

(86) PCT No.: PCT/SE2006/001144
§ 371 (c)(1),
(2), (4) Date: Nov. 13, 2008

(87) PCT Pub. No.: WO2007/061350
PCT Pub. Date: May 31, 2007

(65) Prior Publication Data

US 2009/0199736 A1 Aug. 13, 2009

(30) Foreign Application Priority Data

Nov. 23, 2005 (SE) ..... 0502564

(51) Int. Cl.
*F42B 12/20* (2006.01)

(52) U.S. Cl.
USPC ..... 102/492; 102/494

(58) Field of Classification Search
USPC ..... 102/492, 491, 494, 495, 496, 497, 102/493
See application file for complete search history.

(56) References Cited

U.S. PATENT DOCUMENTS

| | | | | |
|---|---|---|---|---|
| 4,625,650 | A * | 12/1986 | Bilsbury | 102/516 |
| 5,009,167 | A * | 4/1991 | Sippel et al. | 102/524 |
| 5,020,439 | A | 6/1991 | Winter et al. | |
| 6,536,351 | B2 * | 3/2003 | Bocker et al. | 102/478 |
| 6,983,699 | B1 * | 1/2006 | Gold et al. | 102/495 |
| 7,152,532 | B2 * | 12/2006 | Conrad | 102/473 |
| 7,451,704 | B1 * | 11/2008 | Gold et al. | 102/495 |
| 2002/0121215 | A1 * | 9/2002 | Bocker et al. | 102/478 |

FOREIGN PATENT DOCUMENTS

| | | | |
|---|---|---|---|
| DE | 76586 | C | 8/1894 |
| EP | 0887616 | B1 | 9/2002 |
| GB | 1245906 | A | 9/1971 |

OTHER PUBLICATIONS

Supplementary European Search Report issued in Application No. EP06799744 dated Oct. 27, 2011.

* cited by examiner

*Primary Examiner* — James Bergin
(74) *Attorney, Agent, or Firm* — Novak Druce Connolly Bove + Quigg LLP

(57) ABSTRACT

A method for firing explosive-filled, fragmentation shells (1) that disperse fragments on the pre-programmed detonation of their own explosive (7) so as to reduce the risk of accidental injury to unprotected personnel and damage to materiel, which at the moment of firing are undeservedly situated between the firing weapon and the target is provided. Also provided are shells (1) produced or modified according to the method.

6 Claims, 2 Drawing Sheets

MCD SHELL

This application is a national phase of PCT/SE2006/001144, filed on Oct. 10, 2006, which claims priority to SE 0502564-8, filed Nov. 23, 2005, the entire contents of all are hereby incorporated by reference.

TECHNICAL FIELD

The present invention relates to a method of producing or modifying explosive-filled, fragmentation shells that disperse fragments on the pre-programmed detonation of their own explosive, that is to say when the shell bursts. Therefore, when fired from a barreled weapon these present a reduced risk of injury to personnel and damage to materiel, which at the moment of firing are undeservedly situated between the firing barreled weapon and a target.

The invention also relates to an explosive-filled, fragmentation shell that disperses fragments on the pre-programmed detonation of its own explosive, that is to say when the shell bursts, which is modified so that when it bursts the shell presents a reduced risk of injury to personnel and damage to materiel, which at the instant of bursting are undeservedly situated between the firing weapon and the target.

The invention could also be defined as a method of confining the fragment dispersal from such explosive-filled, fragmentation shells, especially artillery shells, that disperse fragments on their own pre-programmed detonation, mainly to forward dispersal in the direction of flight of the shell and laterally thereto. The invention also encompasses a method of modifying older types of shells so that these also acquire the characteristics sought here of dispersing fragments solely in the direction of the target towards which the shell has been fired and laterally in relation to said direction. Finally the invention also encompasses the shells originally produced according to the aforesaid method or shells subsequently so modified.

BACKGROUND OF THE INVENTION

Explosive-filled, fragmentation shells that disperse fragments on their own detonation have conventionally been designed and dimensioned so that they disperse fragments all around, that is to say in all directions. In outright war situations this is generally a distinct advantage rather than a disadvantage.

Global developments have nevertheless led to the ever more legitimate deployment, primarily under UN control, of military and police formations in operations intended to avert outright conflict at various flashpoints, where the Swedish armed forces anticipate being able to fulfill a role, and indeed in several instances are already fulfilling a role. The opponents that may be encountered during such conflict-averting operations may and have already proved to be equipped, even with heavy weapons such as tanks and artillery. This has meant that the formations under UN control must also have access to heavy weapons, the deployment of which must not be impeded by any innocent civilians who undeservedly find themselves in the wrong place from the point of view of peacekeeping soldiers. There is also a problem of damage to civilian property when fighting a hostile force in a civilian environment.

It must always be possible to engage a hostile target, perceived to be a threat by the peacekeeping troops, even if, civilians should undeservedly find themselves between heavy weapons of the peacekeeping troops and the hostile target. Being compelled by the presence of any civilians in the area to refrain from using fragmentation shells during tight situations in peacekeeping operations means giving the opposing side undue advantages.

The desire in these types of operation is therefore for access to fragmentation shells having a frontal impact and a lateral impact well-suited to the intended purpose but entirely devoid of rearward impact in relation to the direction of flight, that is to say a shell which disperses fragments in a forward direction and obliquely forwards towards the intended target and more or less laterally to the direction of flight of the fragmentation shell, but definitely not rearwards in relation to the direction of flight. Explosive-filled, fragmentation shells that disperse fragments on the detonation of their own explosive charge having these specific characteristics have here been called MCD (Minimum Collateral Damage) shells. Even in outright war situations the MCD shell may be a valuable addition to the rest of the arsenal in close combat, such as when fighting in an urban environment. The MCD shells can be allowed to have a very short arming distance, since they do not disperse fragments towards the firing weapon and can therefore also be used against very close targets and close to friendly forces at longer ranges.

BRIEF SUMMARY OF THE INVENTION AND OBJECT

A principal object of the present invention is therefore to produce or to modify a shell for use primarily in situations in which hostile targets are located in or close to a civilian environment and/or close to one's own forces and/or materiel, wherein the shell substantially reduces or entirely eliminates said risks, and at least substantially reducing other problems mentioned in the description, so that the advantageous effects of the shell thus improved may be used against hostile targets in a better way than hitherto.

The stated objects and other aims not listed here are satisfactorily achieved within the scope of the specifications of the independent patent claims. Embodiments of the invention are described in the dependent patent claims.

Thus, according to the present invention, a method has been provided of producing or modifying explosive-filled, fragmentation shells that disperse fragments on the pre-programmed detonation of their own explosive, that is to say when the shell bursts, so that when fired from a barreled weapon these present a reduced risk of injury to personnel and damage to materiel, which at the moment of firing are undeservedly situated between the firing barreled weapon and a target. The method being characterized in that the material parts in the rear body part of the shell, which when the shell bursts, normally give rise to fragments directed rearwards in relation to the direction of flight of the shell, have dimensions or size and thickness so that the fragments formed from these material parts of the shell acquire a rearward velocity away from the centre of detonation of the explosive that is lower than the flight velocity of the shell itself at the instant of bursting.

In further aspects of the method according to the invention:

the material in the parts of the shell body that normally give rise to rearward fragments is thickened by means of a separate thickening material, the separate thickening material is provided by a preferably dished insert, which is applied to conform precisely to the inner wall of the shell inside a space in the shell body intended for the explosive, the thickening material or the insert is produced from a material such as aluminum, which is ignited when the shell bursts and thereby gives rise to a pressure effect together with braking of the velocity of all the fragments formed when the shell bursts and directed rearwards in relation to the direction of flight of the shell, it is used for modifying older shell bodies, previously manufactured and stored.

Furthermore, according to the present invention an explosive-filled, fragmentation shell that disperses fragments on the pre-programmed detonation of its own explosive, that is to say when the shell bursts, has also been provided, and modified so that when it bursts the shell presents a reduced risk of injury to personnel and damage to materiel, which at the instant of bursting are undeservedly situated between the firing weapon and the target. The shell is characterized in that the parts of the material in the rear part of the shell body, which when the shell bursts normally give rise to fragments directed rearwards in relation to the direction of flight of the shell, comprises a thickening material which is dimensioned so that the fragments formed from these parts of the shell acquire a rearward velocity away from the centre of detonation of the explosive that is lower than the flight velocity of the shell itself at the instant of bursting.

In further aspects of the shell according to the invention:

the material in the parts of the shell body that normally give rise to rearward fragments comprises a separate thickening material, the separate thickening material is arranged in the inner rear part of the shell body and comprises a preferably dished, material-thickening insert, the thickening material or the insert comprises a material such as aluminum, which is ignited when the shell bursts.

ADVANTAGES AND EFFECTS OF THE INVENTION

According to the invention, an explosive-filled, fragmentation shell that disperses fragments on the programmed detonation of its own explosive is endowed with the characteristics of a MCD shell by reducing the velocity of the fragments that are formed or which derive from the rear part of the shell, so that the flight velocity of the shell itself prevails and gives a forward and all-round lateral dispersal of fragments in the direction of flight of the shell, that is to say a shaft of fragments widening out forwards and radially in relation to the direction of flight of the shell. The term "programmed detonation" is here primarily intended to denote a desired detonation after firing of the shell, which is triggered via sensors, fuses, timers, electronic circuits etc. which are arranged in the shell in order to determine the correct instant of detonation, as distinct from a desired detonation that is precipitated by some unintended cause, such as a fire in a shell depot, etc. when the shell has not been fired. It will be appreciated, however, that some lesser fragmentation in a specific direction even in the unintended special instance specified here may produce a certain lesser negative effect if the shells are stored in a certain way.

The dynamic fragment dispersal pattern characteristic of the MCD shell can be achieved in that the material in the rear part of the shell is thickened and dimensioned so that fragments deriving or formed from these parts of the shell acquire the desirable lower velocity, that is to say a velocity away from the centre of detonation of the actual explosive forming part of the shell, which is lower than the flight velocity of shell itself at the moment of detonation. This implies a requirement to dimension and design the entire shell solely for this specific purpose, which makes it expensive since the MCD shells will never constitute more than a small special assortment. It also becomes heavy and difficult to stabilize in flight since the centre of gravity is shifted rearwards.

According to one development of the invention, however, it has now also become possible to use shells that are produced in larger series for conventional use and also to modify older shell types to the MCD standard, provided that this is done before the explosive is inserted into the finished shell body. In this variant of the invention this is done by applying a thickening material, dimensioned according to type of shell in question, to the rear part of the shell body. The thickening material is preferably a dished insert which is pressed down into the rear part of the shell where it will increase the material thickness of the solid shell body in the end face thereof facing rearwards in its intended direction of flight and slightly up from said end face along the inside of the internal space intended for the explosive charge of the shell. As soon as the material thickening characteristic of the invention has been applied, that is to say in the embodiment shown as soon as the insert has been pressed into place, the shell can be finished, in this case by pouring in the explosive charge and fitting a fuse etc. Suitable materials for the insert characteristic of the invention primarily include materials which are combustible and which are therefore ignited on detonation of the explosive and thereby, in addition to braking the velocity of the rearward fragments thus formed, also produce a pressure effect when the shell bursts. The result will therefore be to change one type of effect for another, that is to say the fragmentation effect for the pressure effect.

The invention therefore in principle involves a special dimensioning, primarily of the rear part of the shell body, either directly during initial design of the shell or by supplementing an existing type of shell already in production. The actual question to be addressed through an accurate dimensioning is therefore how much material has to be added to an original shell design in order to retard the fragments formed from the rear part of the shell when the shell bursts, in order that these fragments will acquire a rearward and lateral velocity of which the rearward velocity, at least, is less than the forward velocity of the shell at the selected maximum range.

Further advantages and effects will emerge from a study and consideration of the following, detailed description of the invention, including a number of advantageous embodiments thereof, and of the drawings attached.

The method and the arrangement according to the invention have been defined in the following patent claims.

BRIEF DESCRIPTION OF THE DRAWINGS

The invention will be described in more detail with reference to the drawings attached, in which.

DETAILED DESCRIPTION OF EMBODIMENTS

Figure 1:
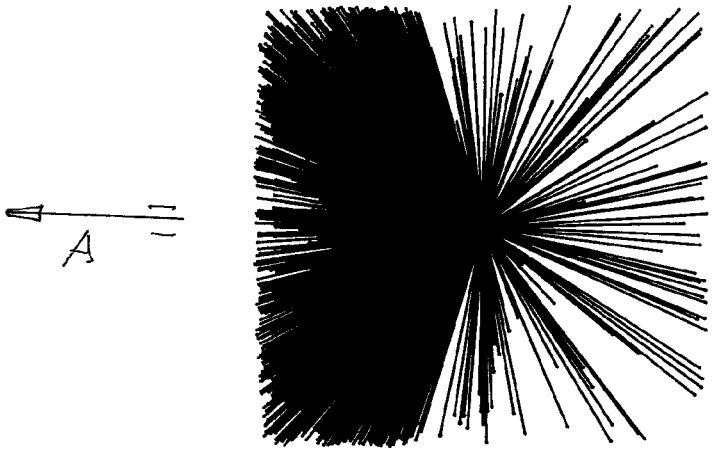
FIG. 1 shows a schematic diagram of a fragment dispersal pattern, masked to show only the central part thereof, emanating from a centre of detonation for a conventional shell
Figure 2:
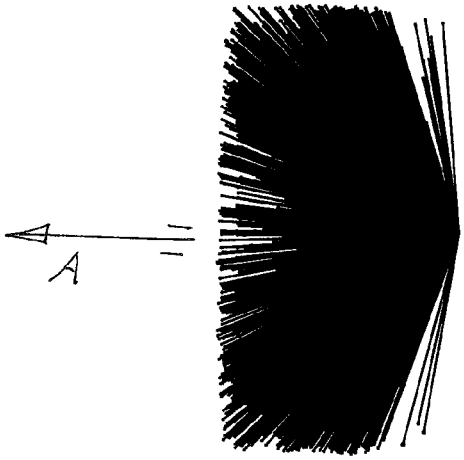
FIG. 2 shows a schematic diagram of the same type for a fragment dispersal pattern for the same basic type of shell but now modified according to the invention into a MCD shell and FIG. 3 shows a diagram of a partially sectional projection of a MCD shell according to the invention.

In FIG. 1 and FIG. 2 the direction of flight of the shells at the instant of bursting is indicated by arrows A, the direction and density of the fragments being apparent from the figures.

It will be seen from FIG. 1 that in the case of the conventional shell the dispersal of fragments rearwards in relation to the direction of flight A is relatively large and therefore constitutes a distinct risk factor, even though it is nowhere near as great as forwards in the actual direction of attack.

Figure 3:
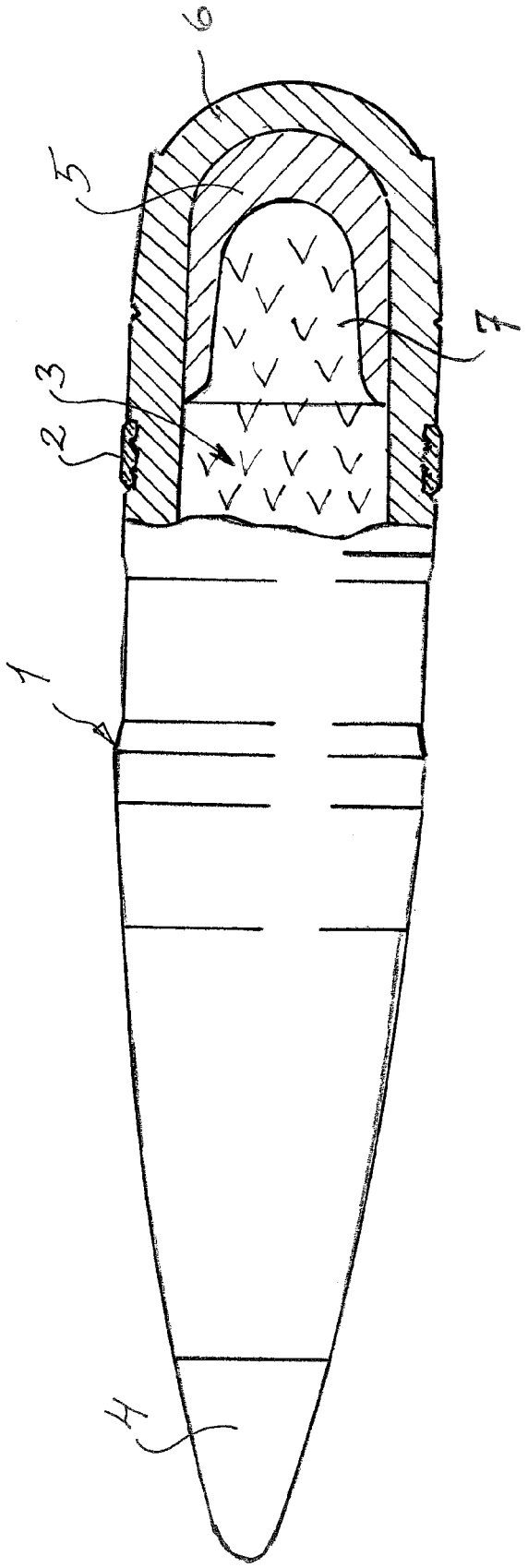

It will further be seen from FIG. 2 that the MCD shell, see FIG. 3, is entirely devoid of any rearward dispersal of fragments, as is desirable. On detonation of the grenade 1 a forward shaft of fragments is formed, which widens out radially in the direction of flight A, and the shape of which is determined by the ratio between the forward flight velocity vector in the direction of flight A of the grenade 1, and the fragment velocity vectors caused by detonation of the grenade 1, which include forward velocity vectors contributing to the forward flight velocity vector, lateral velocity vectors in a radial direction and rearward velocity vectors counteracting the flight velocity vector.

FIG. 3 shows a MCD grenade 1 provided with a belt 2 and a central space 3 filled with explosive 7 and a nose-mounted fuse 4, together with a dished insert 5, which is pressed into the rear part of the space 3 and produces the material thickening 5 of those parts of the body 6 of the shell 1 which would otherwise normally have given rise to rearward fragments. The example shown in the drawing therefore consists of an older more conventional shell modified to a MCD shell 1. In the example shown, the insert 5 is assumed to be made of aluminum, that is to say a material which in the manner previously indicated is ignited when the shell 1 bursts, thereby giving rise to an increase in pressure, that is to say the pressure effect.

ALTERNATIVE EMBODIMENTS

The invention is not limited to the embodiment shown but may be varied in different ways within the scope of the patent claims. It will be appreciated that the material thickening 5 can be undertaken during production of the body 6 of the shell 1 as an integral part of the remainder of the shell body 6, or subsequently by means of a separate, loose insert 5 which is fitted, preferably pressed down into or screwed tight in the shell body 6, for example when the shell 1 is completed in its entirety or, as in the example above, through fitting a local material-thickening insert 5 in connection with the modification of a conventional shell into one having a MCD function.

It will be appreciated that the size, material and shape of the insert forming part of the shell 1 or the thickening material 5 made to the rear part of the shell 1 are adapted according to the effect that is to be achieved, depending, for example, on the effect and quantity of the explosive 7 in question and the estimated flight velocity at the time of detonation of the shell 1 in question.

It will be appreciated that the greater the velocity in the direction of flight A, which the shell 1 is assumed to have at the moment of detonation, the thinner the insert or thickening material 5 at the rear end face of the shell 1 that is required in order to obtain the intended effect, since the greater forward flight velocity vector then permits a higher rearward velocity vector caused by detonation. The required thickening material 5 is therefore also determined by such factors as the shell type, barreled weapon used (howitzer, mortar and so on) etc.

The invention claimed is:

1. An explosive-filled, fragmentation shell that disperses fragments on pre-programmed detonation when the shell bursts, wherein said shell has a forward part and a rear part and is modified so that the shell, upon bursting, presents a reduced risk of injury to personnel and damage to materiel, which at the instant of bursting are undeservedly situated between the firing weapon and the target, wherein the rear part of the shell body, which when the shell bursts normally gives rise to fragments directed rearwards in relation to the direction of flight of the shell, comprises a thickening material, wherein the thickening material is of a size and thickness so that the fragments formed from the rear part of the shell acquire a rearward velocity away from the centre of detonation of the explosive that is lower than the flight velocity of the shell at the instant of bursting of the shell.

2. An explosive-filled shell according to claim 1, wherein the parts of the shell body which normally give rise to rearward fragments comprise a separate thickening material.

3. An explosive-filled shell according to claim 2, wherein the separate thickening material is arranged in an inner rear part of the shell body and comprises a dished material-thickening insert.

4. An explosive-filled shell according to claim 1, wherein the thickening material comprises a material capable of igniting when the shell bursts.

5. An explosive-filled shell according to claim 3, wherein the dished material-thickening insert is used for modifying older shell bodies, previously manufactured and stored.

6. An explosive-filled shell according to claim 4, wherein said material capable of igniting is aluminum.

* * * * *